US005956015A

United States Patent [19]

Hino

[11] Patent Number: 5,956,015

[45] Date of Patent: Sep. 21, 1999

[54] METHOD AND SYSTEM FOR CORRECTING COLOR DISPLAY BASED UPON AMBIENT LIGHT

[75] Inventor: Makoto Hino, Yokohama, Japan

[73] Assignee: Ricoh Company, Ltd., Japan

[21] Appl. No.: 08/574,307

[22] Filed: Dec. 18, 1995

[51] Int. Cl.[6] ..... G09G 5/04

[52] U.S. Cl. ..... 345/153; 348/807

[58] Field of Search ..... 345/150, 153, 345/147, 154, 904; 348/658, 602, 603, 179, 655, 180, 807, 806

[56] References Cited

U.S. PATENT DOCUMENTS

| | | | |
|---|---|---|---|
| 4,500,919 | 2/1985 | Schreiber | 358/78 |
| 4,742,387 | 5/1988 | Oshima | 348/603 |
| 5,272,518 | 12/1993 | Vincent | 348/180 |
| 5,499,040 | 3/1996 | McLaughlin et al. | 345/150 |
| 5,502,458 | 3/1996 | Braudaway et al. | 345/153 |
| 5,532,848 | 7/1996 | Beretta | 348/602 |
| 5,638,117 | 6/1997 | Engeldrum et al. | 345/904 |

FOREIGN PATENT DOCUMENTS 2-22523 2/1990 Japan .

OTHER PUBLICATIONS

Publication entitled "Shikisai–kogaku (Color Engineering)" from *Noboru Oota*, 1993, Chapter 6, pp., 186–191.

Publication entitled "Color–Management System" by K. Shinosawa (1995), 6 pages.

Publication entitled "Shikisai–kogaku (Color Engineering)" from *Noboru Oota*, 1993, Chapter 4, pp. 115–141.

*Primary Examiner*—Chanh Nguyen
*Assistant Examiner*—John Suraci
*Attorney, Agent, or Firm*—Knoble & Yoshida LLC

[57] ABSTRACT

The color matching methods and systems according to the current invention accomplish accurate color matching by separating causes for creating color discrepancies in a predetermined color patch on an image-carrying medium and a color monitor display. In general, the chromaticity values of the predetermined color patch are measured under a standard calorimeter light source whose luminance is different from that of ambient light. The corresponding color is displayed based upon the luminance of the standard light. However, ambient light does not generally have the above luminance. Thus, when the color display is compared against the color patch under ambient light, the colors do not appear identical. To solve this and other problems, the current invention discloses methods and systems to adjust the display signals based upon the luminance of ambient light.

31 Claims, 10 Drawing Sheets

METHOD AND SYSTEM FOR CORRECTING COLOR DISPLAY BASED UPON AMBIENT LIGHT

FIELD OF THE INVENTION

The current invention is generally related to color display monitors and particularly related to color matching a display output on the monitor with a hard copy on an image-carrying medium such as paper.

BACKGROUND OF THE INVENTION

With the advent of powerful personal computers, computer graphics software renders increasingly sophisticated and life-like color images. Color images are also used in various types of application programs. For example, color images are incorporated in desktop publishing. Many desktop publishing software allows users to input color images via an input device such as a scanner, to view as well as edit the color images while viewing on a display monitor, and to print out the images. In other words, the same color images are viewed on various image carrying substrates such as display monitors and hard copies.

One prior art problem is that an outputted color image and its inputted original image do not appear substantially identical in their colors. Because the color characteristics of the input and output devices are not identical, original colors are not exactly reproduced even on the same type of paper. For example, when an original color image is digitized by a scanner, certain light spectra are distorted by the conversion characteristic of the scanner. Similarly, when the digitized image is outputted on a sheet of paper, certain color output is distorted during printing. As a result, the printed color image does not appear true to the original color image. To solve this problem, color management system (CMS) has been developed to control the above-described discrepancies.

In general, the CMS includes device-dependent profiles and a color matching method. Each profile accommodates the input and output characteristics for a specific device, while the color matching method takes care of the device-independent color conversion. There are generally three ways to convert an input color signal to a device-dependent signal. One is to calculate the transformation on the fly using matrix calculations as will be described below. This flexible method also known as masking usually requires central processor time. On the other hand, the second transformation method utilizes memory maps or tables that contain pre-calculated input-to-output mapped values. Because the values are already calculated and stored in the tables, the memory map method does not require a central processing time for calculating values on the fly. However, the memory map method requires additional memory for the tables. In fact, the amount of memory necessary for a vast color spectrum is prohibitive. A third conversion method is a hybrid of the above two methods. That is, a manageable number of input and output values is mapped in a table, and when an input value falls between the mapped values, its output value is calculated based upon a difference between the input value and the mapped input value. The hybrid method substantially reduces the memory size for the map tables.

In the above-described color management system, each color is specified by a set of values. According to "Computer Graphics, Principles and Practice" by Foley et al. (1995), to a human observer, a color is perceived based upon three quantities which include hue, saturation and lightness/brightness. Hue distinguishes among colors such as red, green, purple and yellow. Saturation refers to an amount of whiteness in a particular color. For example, pink is unsaturated with respect to red. Lightness is perceived as intensity of a reflecting object while brightness is the perceived intensity of a self-luminous object such as color display monitor. In contrast to the above-described quantities based upon human perception, another set of terms in colorimetry includes dominant wavelength, excitation purity and luminance which roughly correspond to hue, saturation and lightness/brightness. Among the human perceptible colors specified by the above set of values, most colors may be generated by adding the primary colors (i.e. red, green and blue or RGB). However, to match all values of dominant wavelength in the visible spectrum, certain colors cannot be produced by adding positive values of RGB. In other words, certain primaries must be negative as well as positive to produce all human perceptible colors as shown in FIG. 1. These negative values present some difficulty, for example, in converting output signals to a color monitor.

To solve the above difficulty, in 1931, the commission Internationale de L'Eclairage (CIE) defined three standard primaries, called X, Y and Z colors to replace red, green and blue. The three corresponding color-matching functions, $\bar{x}$, $\bar{y}$ and $\bar{z}$ are shown in FIG. 2. The Y primary is intentionally defined to have a color-matching function that exactly matches the luminous-efficiency function for the human eye. The amount of X, Y and Z primaries needed to match a color with a spectral energy distribution P(λ), are:

$$X=k\,P(\lambda)\bar{x}d\lambda,\ Y=k\,P(\lambda)\bar{y}d\lambda,\ Z=k\,P(\lambda)\,\bar{z}d\lambda$$

For self-luminous objects like a display monitor or cathode ray tube (CRT), k is 680 lumens/watt. For reflecting objects such as paper, k is usually selected such that bright white has a Y value of 100. Furthermore, CIE XYZ defines a color C to be a summation of the weighted primaries as follows:

$$C=xX+yY+zZ$$

where x, y and z are weights and x+y+z=1. Under the CIE XYZ scheme, chromaticity values are defined to depend only on dominant wavelength and saturation and are independent of the amount of luminous energy which is usually denoted by Y. By expressing z in terms of x and y, we can plot x and y for all visible colors, the CIE chromaticity diagram is obtained as shown in FIG. 3. The interior and boundary of the horseshoe-shaped region represent all visible chromaticity values. The center of the horseshoe-shaped region is defined as light source illuminant C, which is meant to approximate sunlight or a standard white light. In other words, the CIE XYZ scheme allows us to measure the dominant wavelength and excitation purity of any color by matching the color with a mixture of the three CIE primaries which is defined only in positive values. In fact, instruments called calorimeters measure tristimulus X, Y and Z values, and the Y value is set at 100.

While the above-described CIE XYZ system specifies any visible color by a set of positive primaries, it does not necessarily reflect our perception of colors. In other words, assume that the distance from color C to color $C_1$ is ΔC and the distance from color C to color $C_2$ is also ΔC, the human subjects do not necessarily perceive these colors $C_1$ and $C_2$ as identical despite the same distance from color C and the independent perception that C and $C_1$, as well as C and $C_2$, are, respectively, a substantially identical color. This is because the human visual system has varied sensitivities across the visible spectrum. In order to construct a system that reflects human perception of colors, CIE has developed the CIE LUV and LAB uniform color spaces in 1976. In general, in these color spaces, two colors that are equally distant are perceived equally distant by a human observer. The two color systems are not interchangeable, and the conversion between the two systems may be only approximated. For the purposes of this disclosure, only the CIE LAB system will be described below.

The CIE LAB scheme is in part defined by L, a and b, and each element in turn is defined by the CIE XYZ primaries according to "Shikisai Kogaku" by Ohta (1993). Generally, L embodies the luminance value while a and b define the color coordinates.

$$L^*=116(Y/Y_n)^{1/3}-16$$

$$a^*=500\{(X/X_n)^{1/3}-(Y/Y_n)^{1/3}\}$$

$$b^*=200\{(Y/Y_n)^{1/3}-(Z/Z_n)^{1/3}\}$$

where $(X_n, Y_n, Z_n)$ are the coordinates of the color that is to be defined as white. In other words, the $(X_n, Y_n, Z_n)$ coordinates is a color of the light off a perfect reflective surface. As a standard, $Y_n$ is defined to be 100. This means that a human observer perceives that colors of an equal distance in the CIE LAB chromaticity coordinates as an identical color under the near day light ($Y_n$=100) condition. However, when the colors are observed under light that is different from the above specified L luminance, they may not be necessarily perceived as the identical colors.

When colors specified under the CIE scheme is displayed on a display monitor such as a CRT, the CIE color specification usually has to be converted into the RGB signals. In general, the RGB system encompasses a subset of visible colors that the CIE system can show. The color gamut covered by the RGB model is defined by the chromaticities of a CRT's phosphors. In other words, two display monitors with different phosphor characteristics cover different gamuts. To covert from colors specified in the gamut of one CRT to that of CIE XYZ, the following matrix transformation is used:

$$\begin{pmatrix} X \\ Y \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R_c) \\ k_G \cdot f_2(G_c) \\ k_B \cdot f_3(B_c) \end{pmatrix}$$

where $X_r$, $X_g$, and $X_b$ are the weights applied to the monitor's RGB colors to find X, and so on.

The above transformation along with the use of the CIE LAB scheme has improved the color management involving a display monitor. However, as described above, color matching between a paper medium and a CRT display has not taken an ambient light condition into consideration. In other words, when an observer compares a color patch under ambient light against its corresponding CRT display, the CRT displays the color specified by the CIE XYZ values that were measured under the near day light ($Y_n$=100) source of a calorimeter. Thus, when the color is displayed on the CRT based upon the above specified L luminance, the human observer does not identically perceive the color patch under the ambient light and the displayed color on the CRT. In the practical application of a color management system, for example, a designer often wants to determine the color coordination on a display monitor without printing on an image-carrying medium. The above-described perceptional difference between the two media due to luminance prevents the designer from relying solely upon the display output.

To improve the above-described problem, Japanese Patent HEI 2-22523 discloses a method of improving the above-described problem in color matching between a color patch and a CRT display. According to the method, the above-described XYZ-RGB matrix transformation is modified to include a set of gamma correction functions $f_1$, $f_2$ and $f_3$ as well as associated coefficients $k_r$, $k_g$ and $k_b$ as follows:

$$\begin{pmatrix} X \\ Y \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R_c) \\ k_G \cdot f_2(G_c) \\ k_B \cdot f_3(B_c) \end{pmatrix}$$

The associated coefficients $k_r$, $k_g$ and $k_b$ are empirically determined under a predetermined test condition where a human observer matches a color display on a CRT with the corresponding adjacently placed color patch. According to the above method, although a CRT monitor and the predetermined color patch are placed in a dark room, an ambient light source is placed over the color patch and a divider prevents the ambient light from reaching the CRT monitor. Under the above-described test condition, the CRT display is adjusted to match the color patch so as to determine the coefficients. The coefficients derived in the above-described manner are used for the correction of other displayed colors.

The above-described prior art attempt still fails to solve some problems associated with color matching between a predetermined color patch and its CRT display. As described above, the color specification in general has hue and lightness or dominant wavelength and luminance. In the above-described prior art attempt, these two components are adjusted at the same time during the coefficient determination. The simultaneous correction of the two color characteristics may be efficient yet is inaccurate since a luminance difference may be compensated by adjusting a dominant wavelength and vice versa.

SUMMARY OF THE INVENTION

To solve the above problem, a method of color matching between a display monitor and an image-carrying substrate, includes the steps of: a) comparing a predetermined color patch on the image-carrying substrate with a corresponding color output on the display monitor under a light condition, the predetermined color patch being specified by a first set of known values, the corresponding color output being generated based upon a second set of signals; b) varying one of the first set of the values so that the predetermined color patch and a corresponding color output on the display monitor appear substantially the same in their color representation; and c) generating each of the signals of the second set based upon the one of the values in the first set.

According to a second aspect of the current invention, a method of correcting predetermined CIE XYZ values of a color patch into RGB values for a viewer under ambient light, include the steps of: a) taking a measurement of the ambient light; b) adjusting the RGB values based upon the measurement for a color presentation on a monitor; and c) further adjusting the RGB values until the viewer perceives that the color presentation matches the color patch.

According to a third aspect of the current invention, a system for color matching between a display monitor and an image-carrying substrate, includes: a predetermined color patch on the image-carrying substrate, the predetermined color patch being specified by a first set of values measured under a predetermined light condition; a display monitor for displaying a color output corresponding to the predetermined color patch, the corresponding color output being generated based upon a second set of signals; a controller for varying one of the first set of the values so as to make the corresponding color output on the display monitor appear substantially identical to the color patch; and a signal generator connected to the controller and the display for generating each of the signals of the second set based upon the one of the values in the first set.

According to a fourth aspect of the current invention, a system for converting predetermined CIE XYZ values of a color patch into RGB values of a monitor for viewing under ambient light, include: a light measuring device for taking a measurement of the ambient light; a first adjustor for adjusting the RGB values based upon the measurement for a color presentation on the monitor; and a second adjustor for further adjusting the RGB values until the viewer perceives that the color presentation the color patch are substantially identical.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 4:
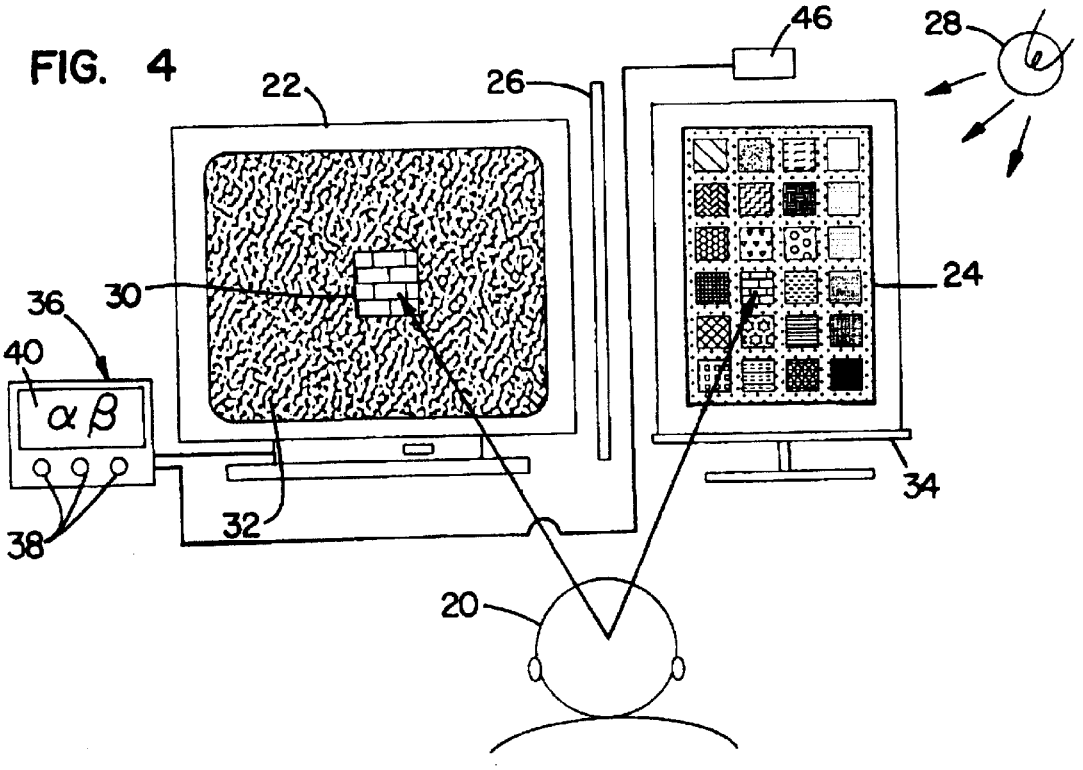
FIG. 4 illustrates an experimental set-up where a human observers determines a perceptually uniform color space between a CRT display and a predetermined color image-carrying medium seen under a particular ambient light.

Referring now to the drawings, wherein like reference numerals designate corresponding structure throughout the views, and referring in particular to FIG. 4, according to one preferred embodiment of the current invention, a human observer 20 views both a CRT display 22 and a predetermined color patch 24 at the same time to determine that they are perceptibly equal. The CRT display 22 is placed adjacent to the color patch 24, and a divider 26 is placed between them. The divider 26 prevents a light source or ambient light 28 placed near the color patch from casting its light to the CRT display monitor 22. In fact, it is preferable that the CRT display monitor 22 is placed in the dark room and that except for a portion of the monitor for showing a color display output 30, the monitor displays a dark background color 32. The predetermined ambient light 28 enables the observer 20 to see the color patch which may be placed on a stand 34. The color patch or color list 24 includes chromatic and/or achromatic color samples.

Still referring to FIG. 4, the above-described preferred embodiment includes a color monitor display controller 36. The controller 36 is connected to a display monitor 22 and houses a central processing unit (CPU) and a memory for storing data and profiles so as to control the display output 30. One preferred embodiment of the controller further includes a set of input means such knobs 38 for a human observer 20 to adjust certain color characteristics of the display output 30 as well as an indicator 40 for indicating current adjusted values such as $\alpha$ and $\beta$ values, which will be described later. In addition, a light sensor 46 placed near the color patch 24 measures ambient light, and the measured signals are sent to the controller 36.

Figure 5:
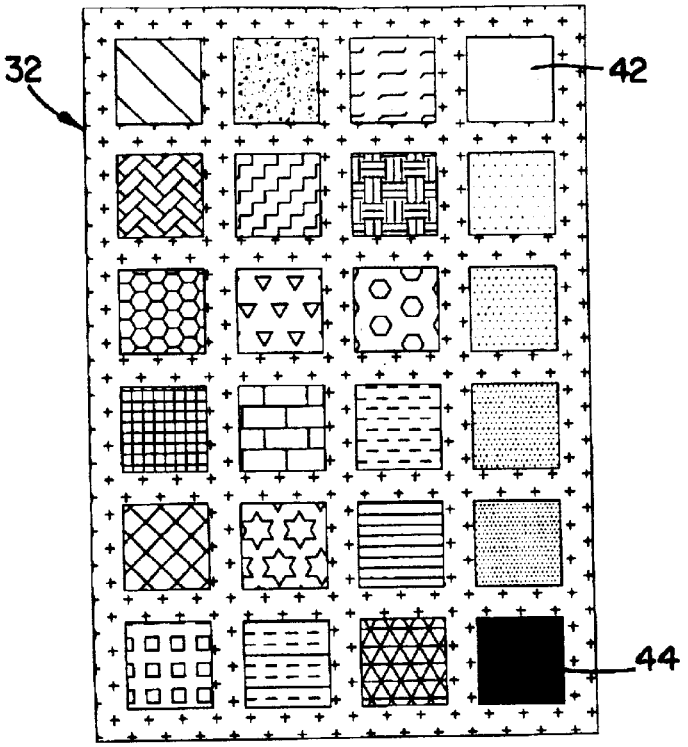
FIG. 5 illustrates one example of a color patch where the first three columns show various chromatic colors while the most right column shows achromatic colors.

Referring to FIG. 5, one preferred embodiment of the color list according to the current invention consists of four columns of sample colors with background 32. The first three columns from the left side of the color patch consist of chromatic color samples. Among these three columns, the most left column consists of high saturation samples while other two columns consist of the lower saturation samples. Within each column, saturation is further varied from the top to the bottom. The most right column consists of achromatic or gray scale samples. In this column, the top sample is white 42 and the bottom sample is black 44. Tri-stimulus XYZ values for each color sample are measured under a light source which is housed in the calorimeter, and generally, according to Japanese Industrial Standard (JIS) Z8722, the values are taken based upon the assumed Y=100 condition.

In the above-described system, in general, the human observer 20 matches a color output 30 on the monitor display 22 with one of the sample color on the patch 24 under a predetermined ambient light 28 by using a monitor display controller 36. The controller 36 includes at least control knobs 38 that adjust certain display characteristics such as brightness, hue and saturation. A display window 40 displays certain characteristics values of the display 30 on the monitor 22. The human observer's perception that the display output 30 and a predetermined color patch 24 are identical depends upon ambient light under which the color patch is viewed.

Figure 1:
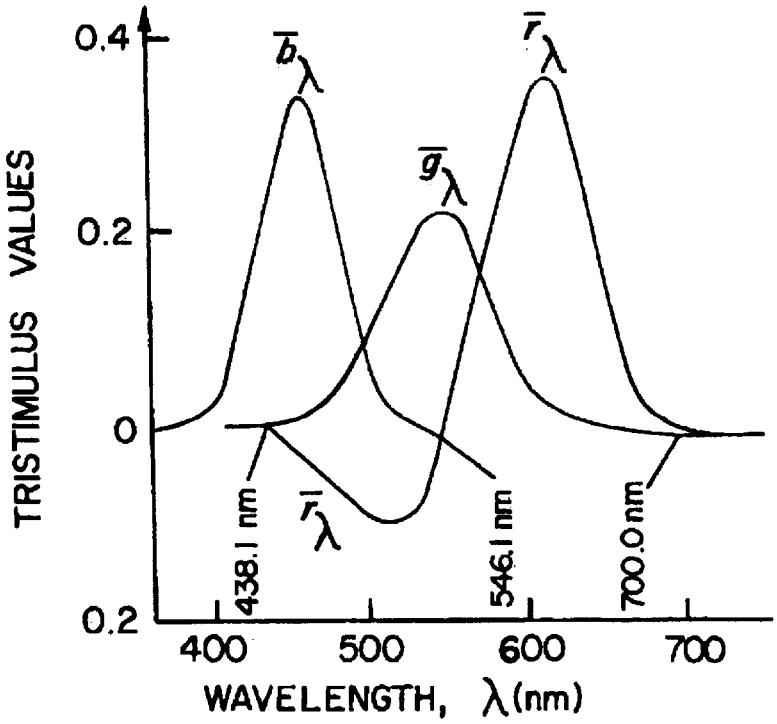
FIG. 1 is a tri-stimulus or RGB functions for matching all the wavelengths of the visible spectrum.
Figure 2:
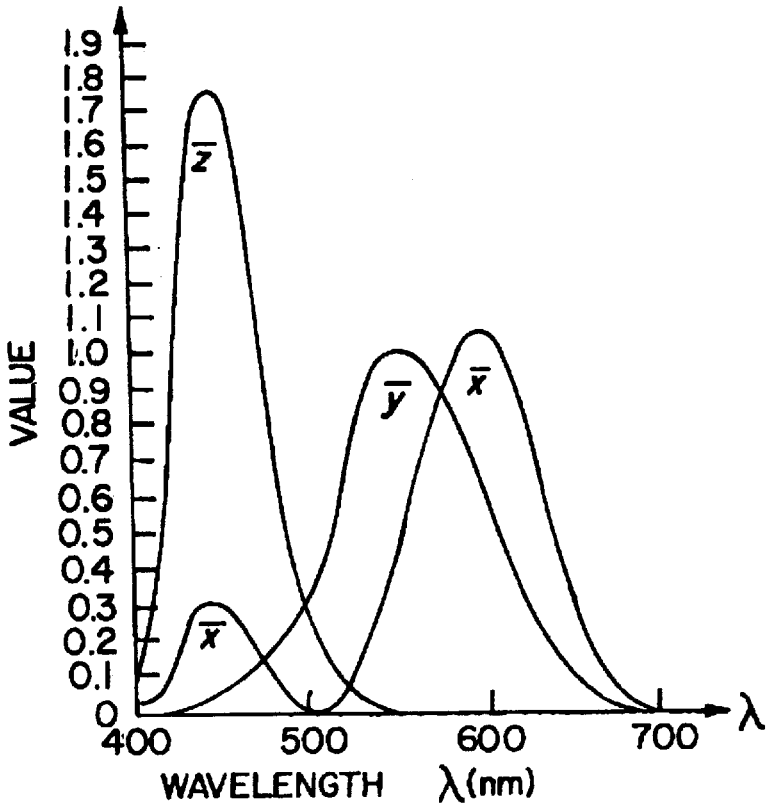
FIG. 2 is another tri-stimulus or CIE XYZ functions for matching all the wavelengths of the visible spectrum.
Figure 3:
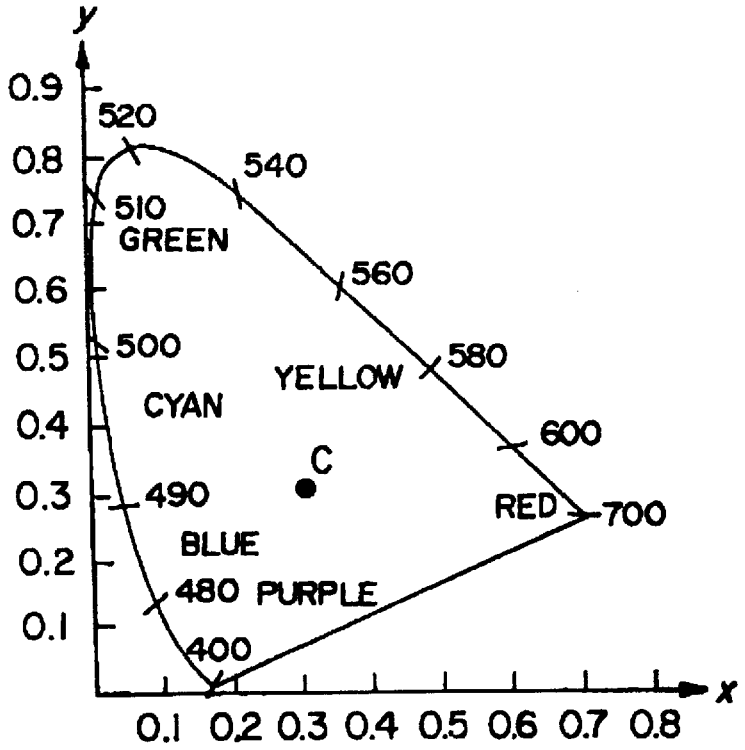
FIG. 3 is the CIE chromaticity diagram, and C indicates the position of illuminant C.
Figure 6:
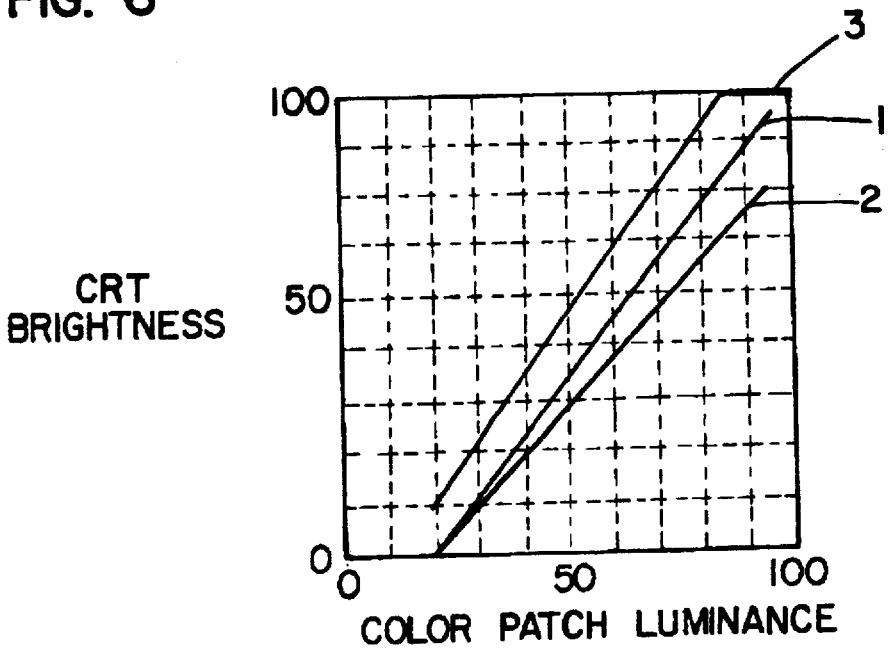
FIG. 6 shows a graph that illustrates that a perceptually uniform color space between a CRT display and a predetermined color image-carrying medium depends upon ambient light.

One ambient light effect is illustrated in a graph as shown in FIG. 6. As described above, the chromaticity values of the color samples were measured at a predetermined luminance (Y=100). However, when a human observer compares the color patch to the monitor display, the color patch is viewed at the luminance of the ambient light. In the graph, the X axis indicates the luminance of the ambient light and the Y axis indicates the brightness of the self-luminous CRT. The luminance is calculated by converting the Y value of the CIE tri-stimulus XYZ values using the following equation:

$$L^*=116(Y/Y_n)^{1/3}-16$$

where $Y_n$ is the largest value in the RGB signal. According to FIG. 6, humans perceive that the luminance of the color patch and the CRT brightness of the display output are directly related. In this regard, the line 1 shows the above-described direct correlation when the luminance of the ambient is 900 luxes. Similarly, the lines 2 and 3 respectively show that the ambient light was 600 and 1900 luxes. Thus, FIG. 6 shows that the luminance of the ambient light under which the observer views the color patch affects the above-described perception.

In addition to the above-described luminance effect, the ambient light and the standard calorimeter light may have a different light source illuminant, which is meant to approximate sunlight or a standard white light. The calorimeters usually have a built-in light source under which chromaticity values are measured. These standard light sources are calibrated to be D50, D65 and so on. On the other hand, ambient light is generally not near close to these standard lights. This difference in light source illuminant may be appreciated when one views the same color sample under a light bulb in a room and under the sun in the outdoors. To account for the above-described light source shift, referring to FIG. 7, each of the multiple color lists a through h is displayed on a monitor based upon a particular standard light condition. For example, list a is to closely match a color patch viewed under a D50 light source. Similarly, list b is to closely match the same color patch viewed under a D65 light source. In matching a color patch under ambient light with a display output, a human observer selects one display output from the displayed lists a–h that appears closest to the color patch.

Figure 8:
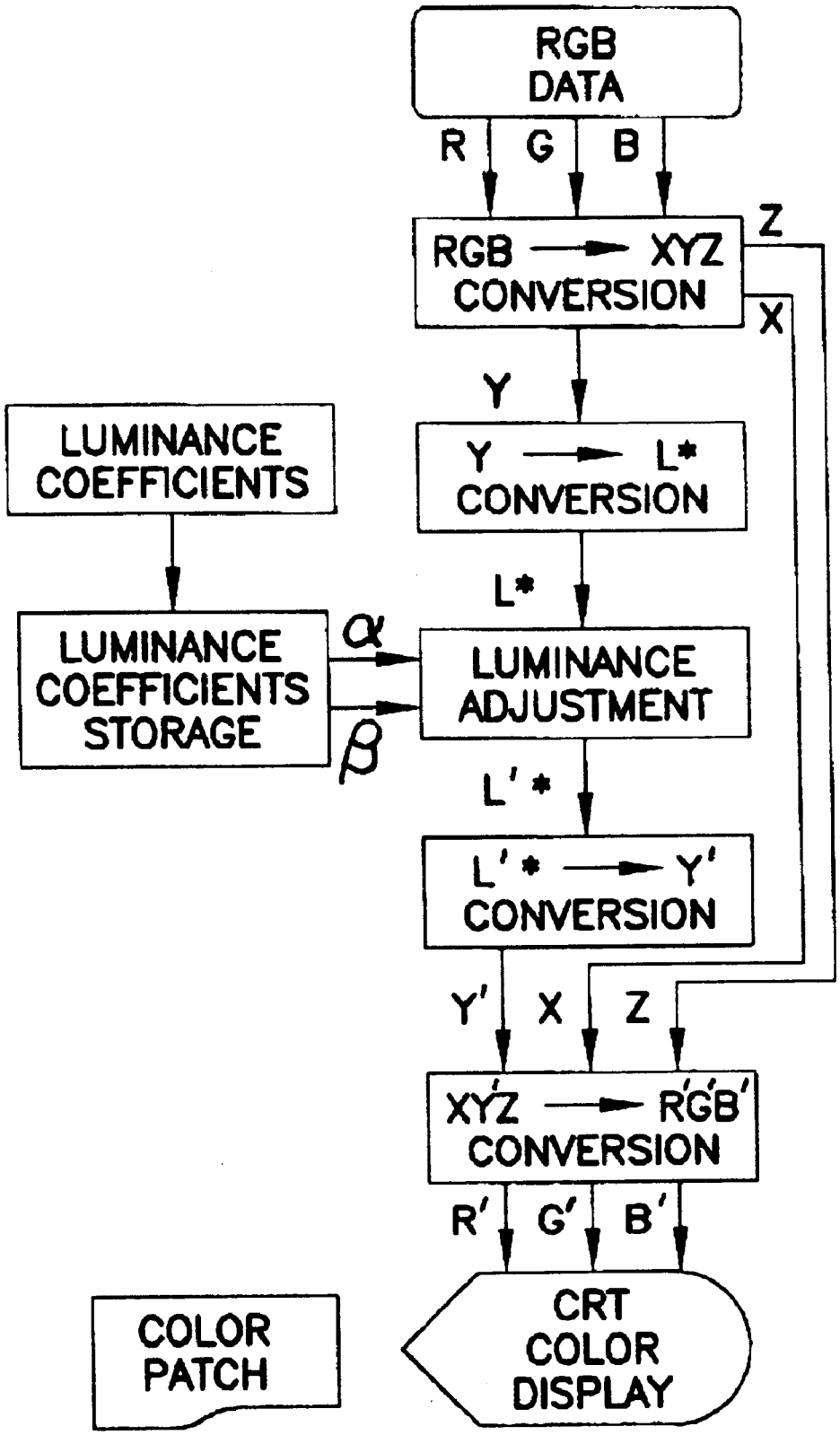
FIG. 8 is a flow chart for illustrating one preferred embodiment of the current invention where pairs of predetermined luminance conversion coefficients a and a are inputted into a luminous conversion unit from a storage so as to find a best color match between a color patch and its corresponding CRT display.

Referring to FIG. 8, the above-described method of color matching will be more fully described using a flow chart. In this preferred method according to the current invention, the calorimeter light source and the ambient light are assumed to have the substantially identical light source illuminant C but have different luminance. To correct the luminance for color matching, if the color patch data is in the RGB format, it is converted into XYZ values in the RGB-XYZ conversion step. For example, this conversion is accomplished by using the following equation as disclosed in Japanese Patent 2-22523:

$$\begin{pmatrix} X \\ Y \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R_c) \\ k_G \cdot f_2(G_c) \\ k_B \cdot f_3(B_c) \end{pmatrix} \quad (1)$$

where $k_r$, $k_g$ and $k_b$ are associated coefficients and $X_r$, $X_g$ and $X_b$ are the weights applied to the monitor's RGB colors to find X, and so on.

The Y value is further converted into a L* luminance value by the following equation:

$$L^*=116(Y/Y_n)^{1/3}-16 \quad (2)$$

where $Y_n$ is the highest RGB signal value. That is, if the RGB signal for a particular display monitor ranges from 0 to 255, $Y_n$ is 255. The X and Z values are not processed at this time.

The converted luminance L* is adjusted in the luminance adjustment step by varying two parameters α and β which are related as follows:

$$L'^*=\alpha(L^*-\beta) \quad (3)$$

where α and β are luminance conversion coefficients and are empirically determined. The coefficient α is directly related to ambient light and seen as an incline of the plotted line in FIG. 6. In general, the higher the luminance of the ambient light is, the steeper the incline becomes. The other coefficient β corresponds to the lowest luminance of a portion in a color image. In FIG. 6, β is an intercepting point between the X axis and the plotted line. In other words, the higher the luminance of the ambient light is, the lighter a dark image becomes. Still referring to FIG. 6, when the ambient light is 600 or 900 luxes, the CRT brightness for a black color display is approximately zero. In contrast, under 1900 luxes of ambient light, the CRT brightness for the black color becomes above zero. However, 1900 luxes of ambient light is almost non-existent under a normal lighting condition.

Now referring back to FIG. 8, according to one preferred embodiment of the current invention, pairs of predetermined luminous conversion coefficients are stored in a storage, and each of these pairs is applied for adjusting the L* value at a time. For each adjustment, the adjusted luminance value L'* is converted back to the Y format or a Y' value in the L'*–Y' conversion step by the following equation which is reverse to the equation (1):

$$Y'=Y_n((L'^*+16)/116)^3 \quad (4)$$

The Y' value along with X and Z values are substituted back to the equation (1) to generated adjusted RGB signal values for generating the adjusted RGB signals or R'G'B' signals which are outputted to a CRT color display monitor. The adjusted color output on the monitor is compared against the predetermined color patch. The above-described process is repeated for each pair of the stored α and β pairs or until a human observer declares that the displayed color is substantially identical with the color patch.

In the above preferred embodiment, if the human observer does not perceive that the adjusted color display and the color patch are substantially identical, he or she is able to change either of the luminance coefficients in the luminance coefficient application step. Based upon the modified α or β value, a new L'* value is determined in the luminance adjustment step and is subsequently converted to a new Y' value for generating re-adjusted R'G'B' signals. The above-described observer manipulated color matching process may be repeated until the observer satisfies that the compared colors are substantially identical.

Still referring to FIG. 8, according to a second preferred embodiment of the current invention, the luminance conversion coefficient β might be set as a constant for all of the stored coefficients. The lowest luminance portion of the predetermined color patch is measured, and the measured value is set as the luminance conversion coefficient β. In the alternative, if an approximate lowest luminance value for a certain image-carrying medium is known, the value is assigned to β. For example, a dark portion of a photograph has an approximate luminance value of 2.0. By making the β value constant, a human observer deals with only one variable so as to better color match the displayed color and the color patch.

In the above preferred process, if the human observer does not perceive that the adjusted color display and the color patch are substantially identical, he or she is able to change either of the luminance coefficients in the luminance coefficient application step. Based upon the modified α or β value, a new L'* value is determined in the luminance adjustment step and is subsequently converted to a new Y' value for generating re-adjusted R'G'B' signals. The above-described observer assisted color matching process may be repeated until the observer satisfies that the compared colors are substantially identical.

Still referring to FIG. 8, according to a second preferred embodiment of the current invention, the luminance conversion coefficient β might be set as a constant for all of the stored coefficients. The lowest luminance portion of the predetermined color patch is measured, and the measured value is set as the luminance conversion coefficient β. In the alternative, if an approximate lowest luminance value for a certain image-carrying medium is known, the value is assigned to β. For example, a dark portion of a photograph has an approximate luminance value of 2.0. By making the β value constant, since a human observer deals with only one variable, he or she may be able to better color match the displayed color and the color patch.

Figure 9:
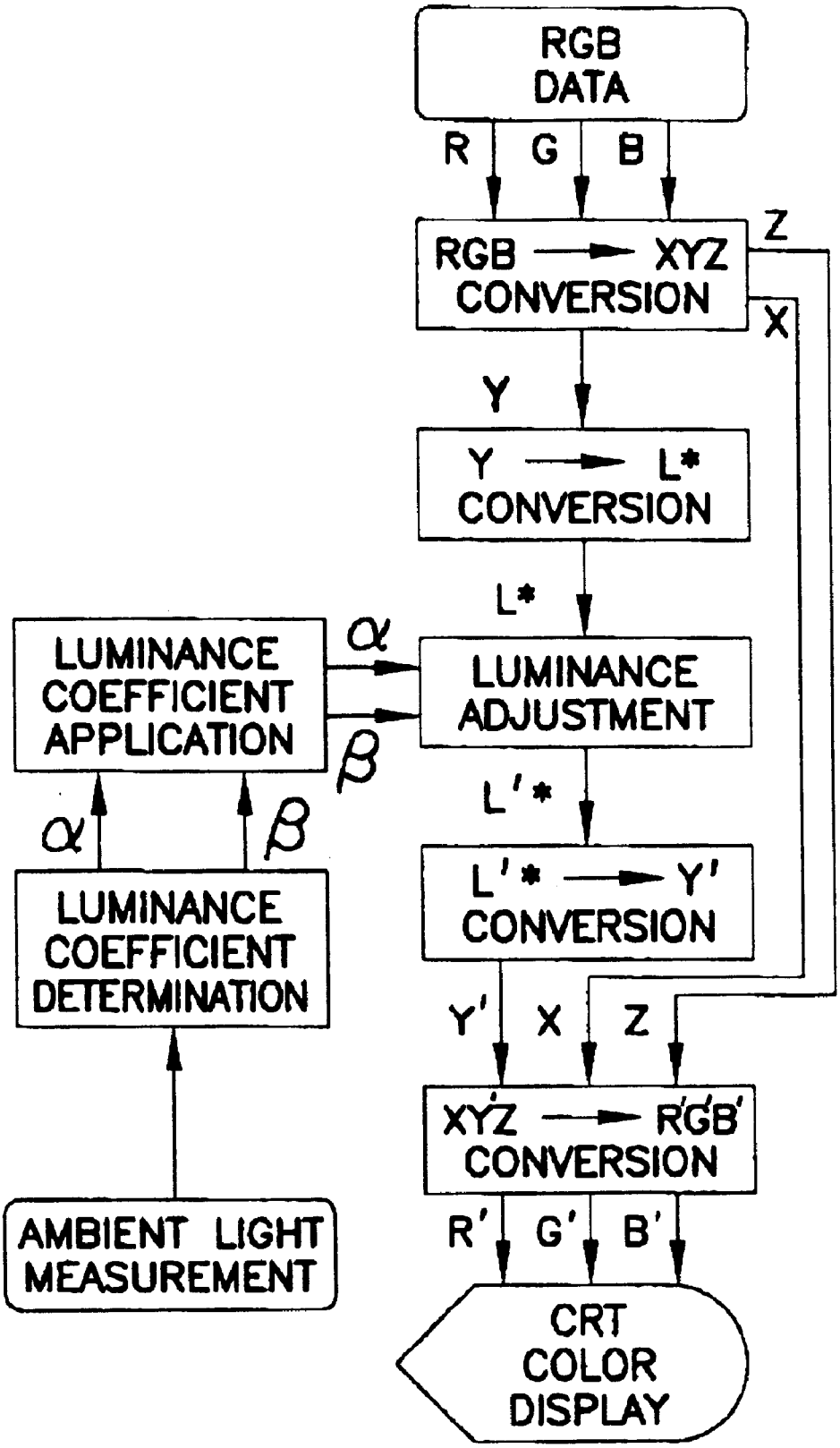
FIG. 9 is a flow chart for illustrating a second preferred embodiment where a pair of luminance conversion coefficients $\alpha$ and $\beta$ is determined based upon ambient light under which the color patch is observed.

Referring to FIG. 9, according to a third preferred embodiment of the current invention, the basic concept of the color matching as described with respect to FIG. 8 is the same except for the determination and application of the luminance conversion coefficient α. The same condition includes that the calorimeter light source and the ambient light are also assumed to have the substantially identical light source illuminant C but they are also assumed to have different luminance. To determine the luminance conversion coefficient α, ambient light is measured for its luminance by a light measuring device. The measuring device should be located near a color patch. The measured luminance value is further processed to select a corresponding α value in a luminance coefficient determination step. Either a conversion table or on-the-fly calculation is used to determine an appropriate α value. In contrast, predetermined a values are stored in a storage, and an appropriate β value is selected based upon a predetermined condition. In the alternative, a constant β value may be used. A pair of α and β values is applied in the same manner to determine the L'* value in the luminance adjustment step as described with respect to FIG. 8.

In the above-described third preferred embodiment, the luminance coefficient application step is repeated under certain conditions. A human observer does not manipulate the luminance conversion coefficients when they are first determined. However, if the human observer does not perceive that the adjusted color display and the color patch are substantially identical, he or she is able to change either of the luminance coefficients in the luminance coefficient application step. Based upon the modified α or β value, a new L'* value is determined in the luminance adjustment step and is subsequently converted to a new Y' value for generating re-adjusted R'G'B' signals. The above-described observer assisted color matching process may be repeated until the observer satisfies that the compared colors are substantially identical.

Figure 10:
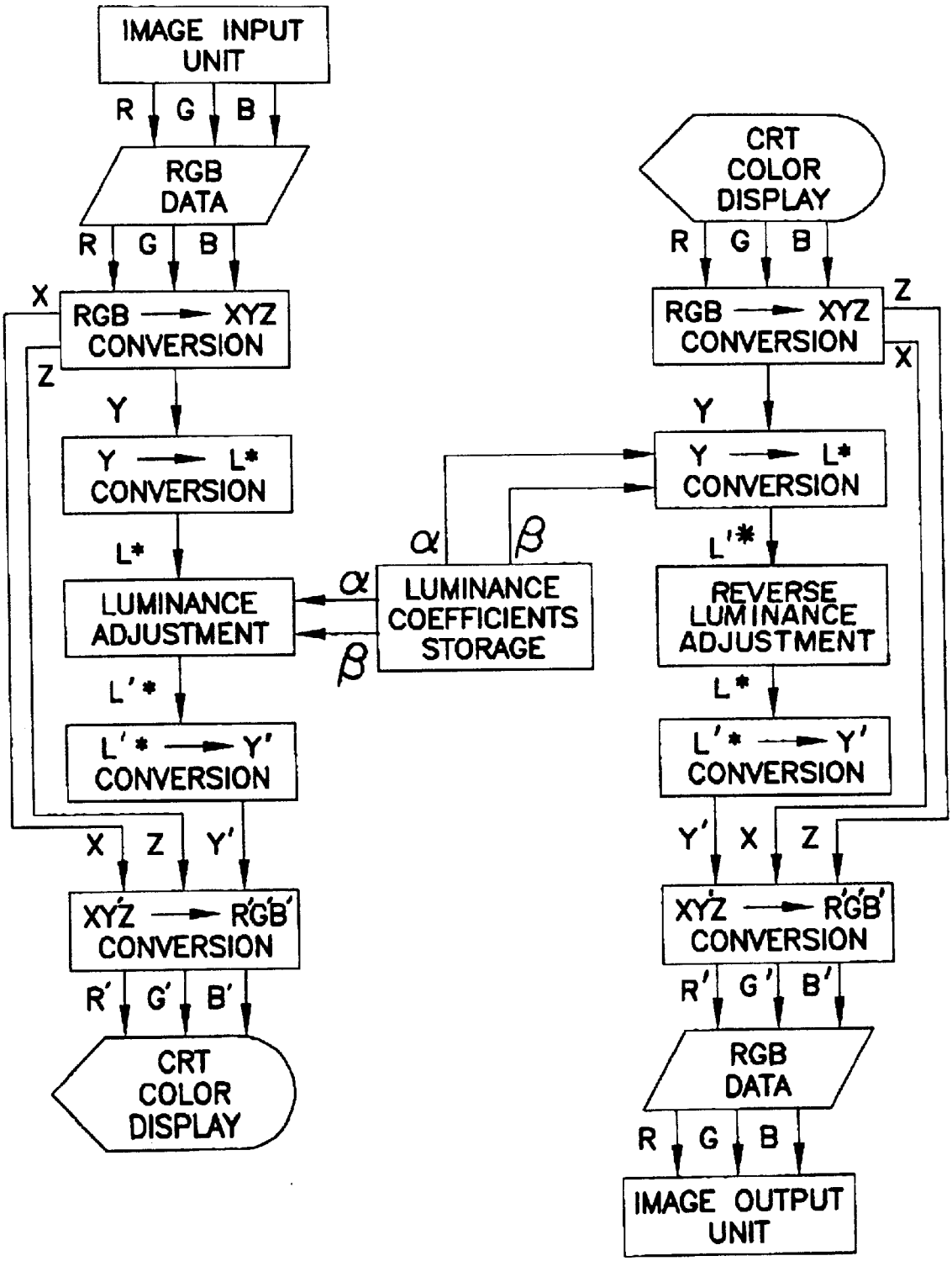
FIG. 10 illustrates that a pair of luminance conversion coefficients $\alpha$ and $\beta$ is used in a forward direction as already shown in FIG. 5 as well as a reverse direction in which RGB data from the color display is converted back to image data.

Now referring to FIG. 10, according to a fourth preferred method of the current invention, the above-described concept of luminance adjustment in color matching is used in connection with various input and output devices. In this preferred process, the calorimeter light source and the ambient light are again assumed to have the substantially identical light source illuminant C but have different luminance. The left side of the flow chart in FIG. 10 is related to the use of the above luminance adjustment involving an input device such as a scanner and an output device such a color display monitor. After an image or a color patch is inputted by a scanner into the RGB data, the processes described with respect to FIGS. 8 and 9 are applied to generate an adjusted RGB signals based upon the luminance conversion coefficients α and β so as to color match the inputted color and the outputted display under ambient light. The variations described in reference to FIGS. 8 AND 9 FOR determining a pair of α and β values are also applicable to this preferred method.

Still referring to FIG. 10, the right hand side of the flow chart describes a situation where a color is initially specified on a display terminal and later reproduced on an image-carrying medium. After a set of RGB values is generated and the corresponding color is displayed on a display monitor, a process that is reverse to the above-described luminance adjustment is performed. That is, the reverse luminance adjustment step converts the adjusted luminance L'* back to unadjusted luminance L based upon the specified α and β. When a set of RGB values is generated based upon the unadjusted luminance L* and the corresponding color is outputted on an image-carrying medium by the image output unit, the outputted color and the original display appear substantially identical to a human observer. If the human observer does not perceive that the adjusted color display and the color patch are substantially identical in a comparison illustrated in either side of the flow chart in FIG. 10, he or she is able to change either of the luminance coefficients α and β in the luminance coefficient application step.

Figure 11:
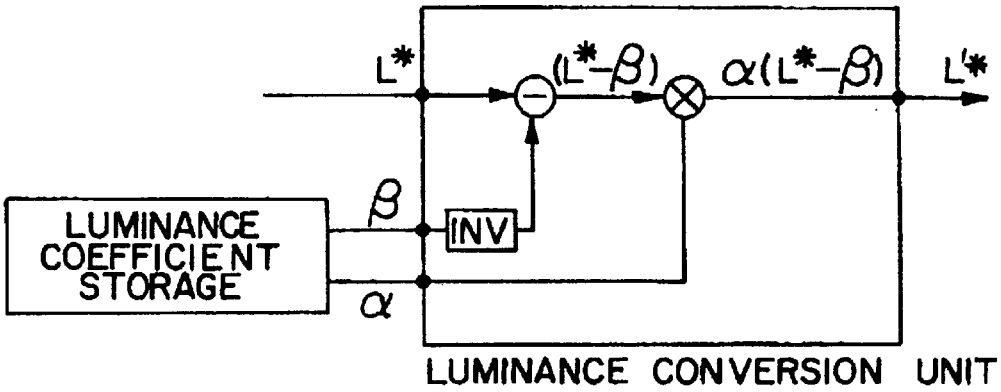
FIG. 11 diagrammatically illustrates a luminous conversion circuit.
Figure 12:
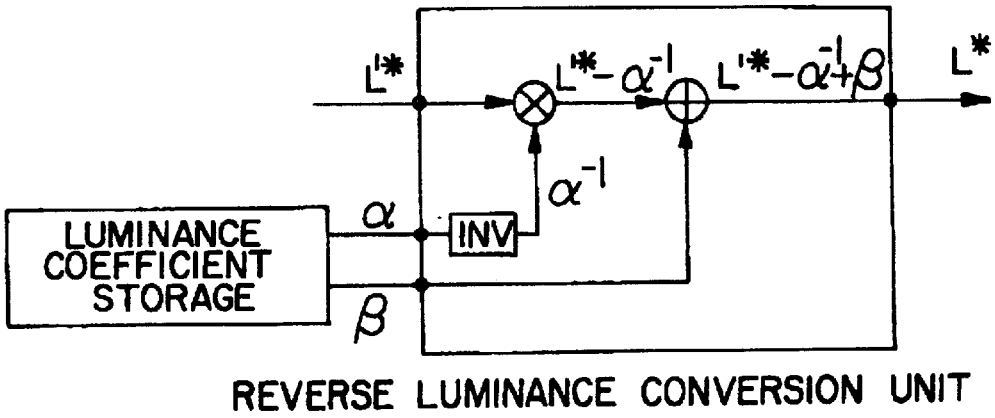
FIG. 12 diagrammatically illustrates a reverse luminous conversion circuit.

Referring to FIGS. 11 and 12, luminance conversion/adjustment unit and a reverse luminance conversion/adjustment unit are respectively depicted. A luminance conversion unit adjusts L* to L'* based upon the luminance conversion coefficients α and β. One example of such a conversion process is the above-described equation (3), and its corresponding circuit is diagrammatically illustrated in FIG. 11. First, β is subtracted from L*, and then the result is multiplied by α. In contrast, the reverse luminance conversion/adjustment unit adjusts the luminance value in the opposite direction as shown in FIG. 12. Using the same example, first L*' is multiplied by $\alpha^{31\ 1}$, and then β is added to the result. These luminance conversion/adjustment units may be implemented by either software, hardware or a combination.

Figure 13:
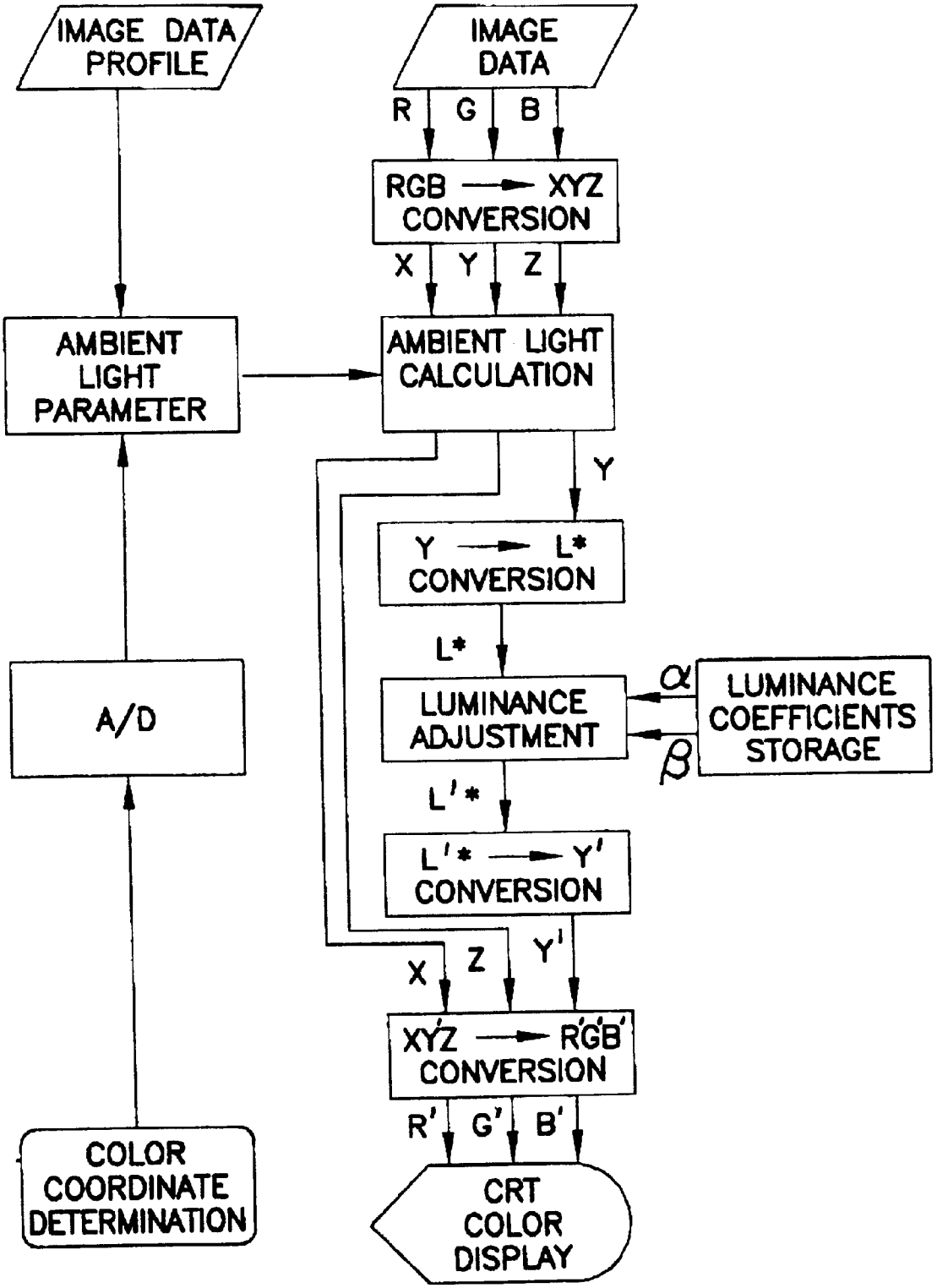
FIG. 13 is a flow chart for illustrating a third preferred embodiment where an image data profile and ambient light data are used to adjust a monitor display based upon a difference between the two light conditions before an observer adjusts the conversion coefficients $\alpha$ and $\beta$.

In contrast to the above-described preferred methods and systems, FIG. 13 describes preferred methods and systems for color matching between a CRT display and a predetermined color patch under ambient light whose luminance and light source illuminant are both different from those of a standard calorimeter light source. Due to the difference in light source illuminant or the light shift, according to a fifth preferred method, inputted color image data is first converted into the XYZ format and then is adjusted to compensate for the difference in light source illuminant of the ambient light. For this purpose, the CIE has considered chromatic adaption formula. One way to obtain the chromatic adaption formula includes the XYZ value measurements of multiple color patches under ambient light and a standard light $D_{50}$, and the measured XYZ values are converted into two sets of the LAB values in the uniform color space. Then, based upon the two sets of LAB values, coefficients for a conversion formula between the two LAB values are determined so as to minimize the color difference. After the light shift has been adjusted in an ambient light calculation step, the Y value is further adjusted based upon the luminance conversion coefficients α and β as described with respect to FIGS. 8–10.

Still referring to FIG. 13, according to a sixth preferred method of the current invention, to compensate for the light shift, a certain device is used to determine the chromaticity coordinates of ambient light. The measured chromaticity information is digitized by an A/D converter, and the digitized chromaticity information is used in an ambient light parameter determination step. In addition to the above measurements, certain chromaticity information on the calorimeter standard light as well as ambient light is also used in the ambient light parameter step to determine the difference in the chromaticity coordinates. Such chromaticity information is stored in an image data profile which is associated with the color patch. The image profile also contains other information such as the above-described CIE conversion equations and a predetermined chromaticity range.

According to another aspect of the above-described preferred methods and systems, if measured chromaticity values of ambient light are outside of a predetermined range, a user of the system is notified. This notification is useful in identifying a situation where an ambient light source is altered from its originally expected condition for maintaining the accuracy or integrity of the system. For example, if a skin color needs to be accurate, then the chromaticity values for the skin color should be set within a relatively narrow range. In response to the out-of-range notice, a user of the system re-calibrates the system based upon the chromaticity measurements of ambient light.

Figure 14:
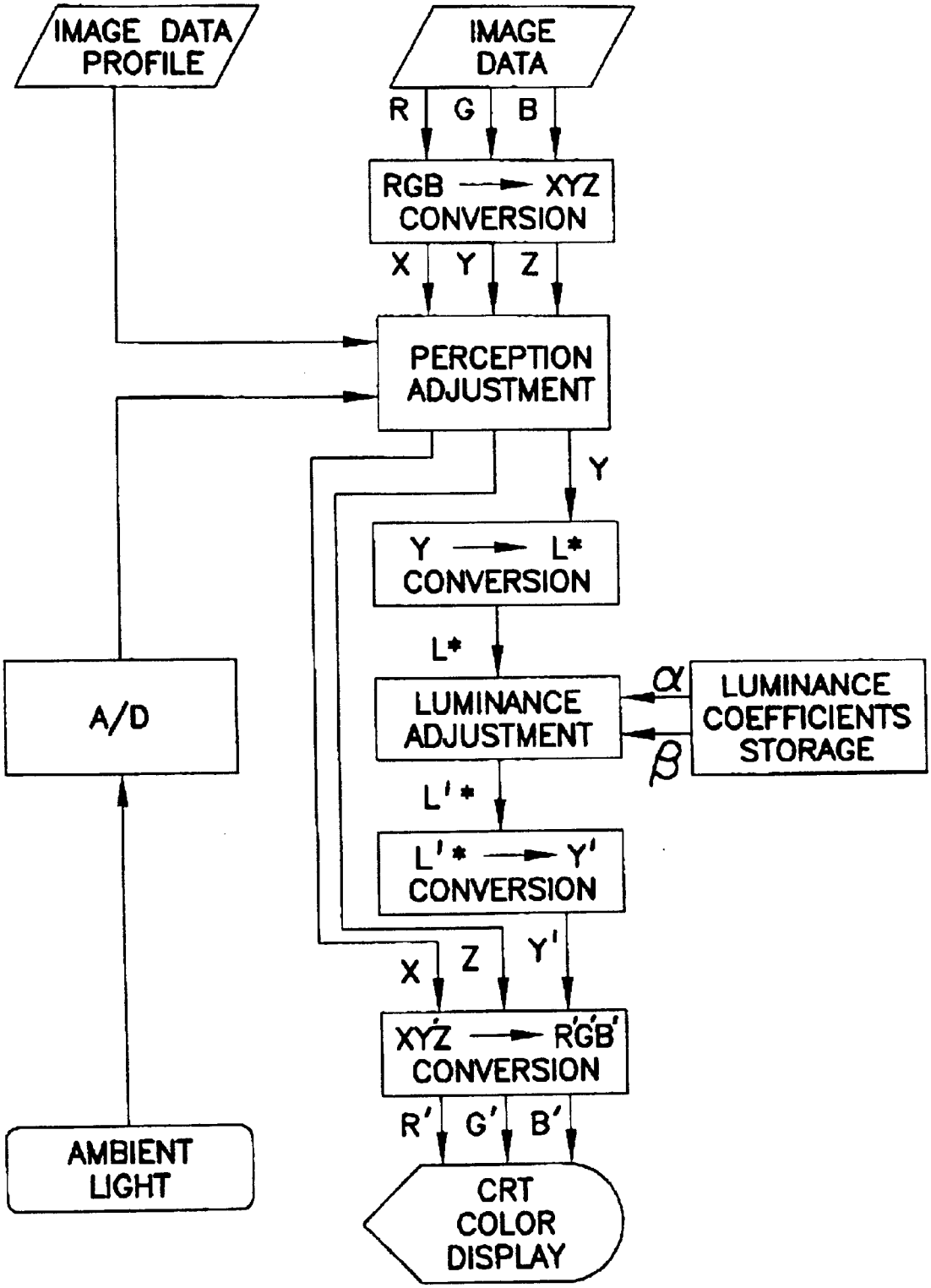
FIG. 14 is a flow chart for illustrating a fourth preferred embodiment where an image data profile and ambient light data are used to adjust a monitor display based upon a predetermined equation for human perception based upon a difference between the two light conditions before an observer adjusts the conversion coefficients $\alpha$ and $\beta$.

Referring to FIG. 14, according to a seventh preferred method of the current invention includes steps for color matching between a CRT display and a predetermined color patch under ambient light whose luminance and light source illuminant are both different from those of a standard calorimeter light source. The basic concept as described with respect to FIG. 13 is the same except for the conversion or adjustment based upon the human perception. To compensate for the difference in the light source illuminant, the XYZ values are adjusted based upon the equations that account for the human perception such as the vonKries' color-appearance model or the Nayatani's color-appearance model. After the light shift has been adjusted in an ambient light calculation step, the Y value is further adjusted based upon the luminance conversion coefficients α and β as described with respect to FIGS. 8–10.

Figure 7:
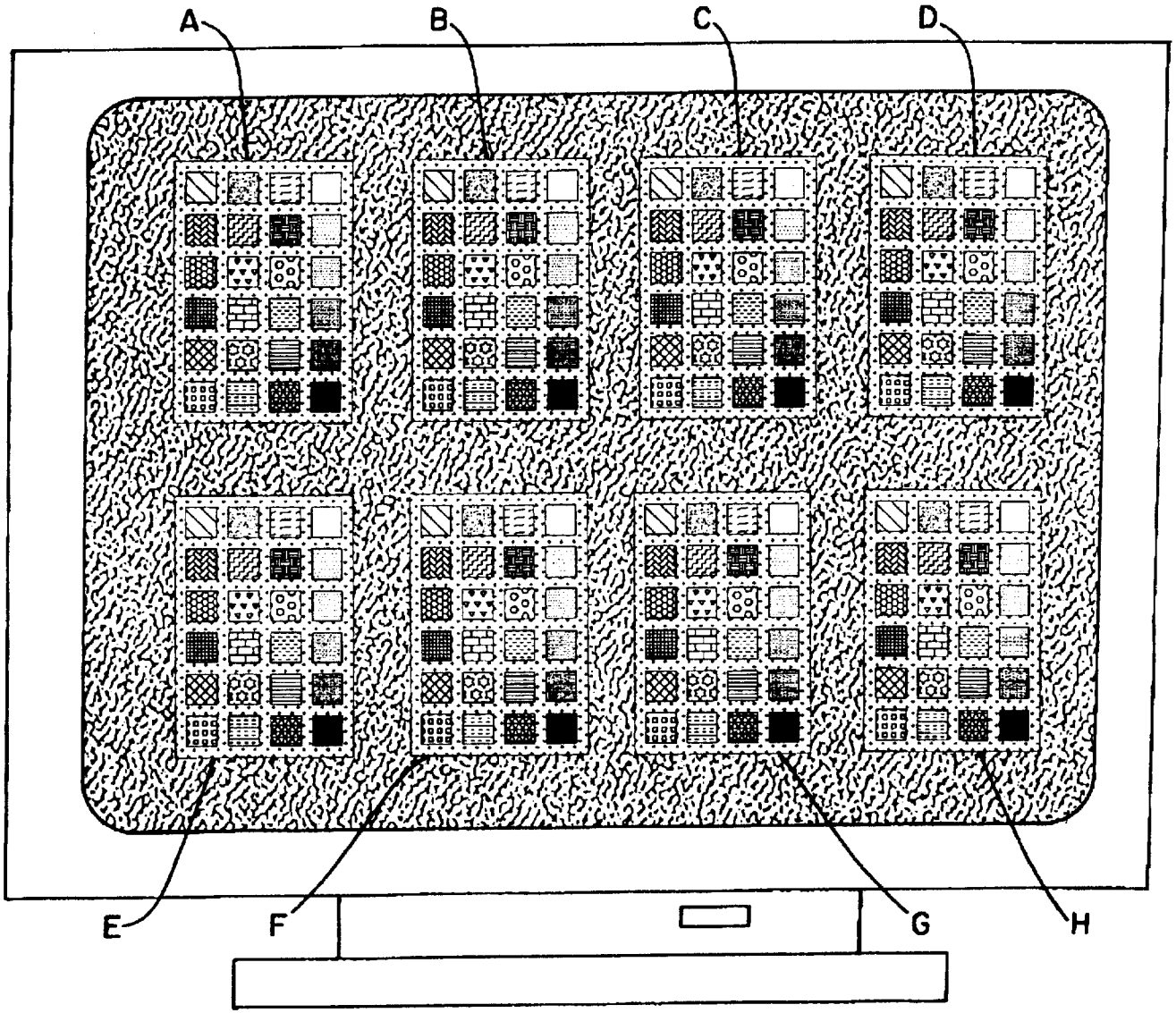
FIG. 7 illustrates a display on a CRT which includes multiple color sets which would be seen under various standard ambient light conditions.

In the above-described preferred embodiments, various color output displays are generated under multiple light conditions. These various displays are displayed on the same monitor screen as shown in FIG. 7. If a human observer does not see any of these displays matches a predetermined color patch, he or she adjusts the luminance coefficients α and β until he or she satisfies with the best matched color display as described with respect to FIGS. 8–10.

It is to be understood, however, that even though numerous characteristics and advantages of the present invention have been set forth in the foregoing description, together with details of the structure and function of the invention, the disclosure is illustrative only, and changes may be made in detail, especially in matters of hardware, software and combination of both. For example, in the above preferred embodiments, the conversion steps as illustrated by the use of the equations (1)–(4) may be performed by software, hardware or a combination of both. Furthermore, the equations (1)–(4) are mere examples and other transformations may be used. The principles of the invention to the full extent is indicated by the broad general meaning of the terms in which the appended claims are expressed.

What is claimed is:

1. A method of color matching between a display monitor and an image-carrying substrate, comprising the steps of:

a) comparing a predetermined color patch on the image-carrying substrate with a corresponding color output on the display monitor under a light condition, said predetermined color patch being specified by a first set of known values according to a first color system, said corresponding color output being generated based upon a second set of signals according to a second color system, said first set of values including CIE tristimulus x, y, and z values while said second set of signals including RGB signals;

b) making a change in said y value which is an intensity related value of said first set of said values so that said predetermined color patch and said corresponding color output on the display monitor appear substantially identical in their color representation, said step b) further comprising:

iii) converting said Y value into a L* value defining luminance by a first equation, $L^*=116\,(Y/Y_n)^{1/3}-16$, $Y_n$ being defined as 100.

iv) modifying said L* value by luminance conversion coefficients α and β into L'* which is defined by $\alpha(L^*-\beta)$; and v) converting said L'* back to a modified a Y' value which is defined by $Y_n((L'^*+16)/116)^3$; and c) generating each of said signals of said second set based upon said change in said intensity related value in said first set.

2. The method of color matching according to claim 1 wherein said step b) further comprises an additional steps of:

i) taking a measurement of said light condition; and ii) automatically adjusting said Y value based upon said measurement.

3. The method of color matching according to claim 2 further comprising an additional step of indicating that said measurement is outside of a predetermined range of values.

4. The method of color matching according to claim 1 wherein said Y' value along with said X and Z values are substituted in the following equation for determining $R'_C$, $G'_C$ and $B'_C$:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

5. The method of color matching according to claim 1 wherein said luminance conversion coefficients α and β are predetermined and stored in a memory.

6. The method of color matching according to claim 1 wherein said luminance conversion coefficients α and β are determined on the fly.

7. The method of color matching according to claim 1 wherein said predetermined color patch and said corresponding color output are compared under a substantially identical light condition in said step a).

8. The method of color matching according to claim 1 wherein said predetermined color patch and said corresponding color output are compared under different light conditions in said step a).

9. The method of color matching according to claim 8 wherein said corresponding color output is viewed in a dark room.

10. The method of color matching according to claim 8 wherein said first set of known values are adjusted based upon said different light conditions.

11. A method of correcting predetermined CIE XYZ values of a color patch into RGB values for a viewer under ambient light, comprising the steps of:

a) taking a measurement of the ambient light of substantially identical chromaticity coordinates of those for the predetermined CIE XYZ;

b) adjusting the RGB values based upon the measurement for a color presentation on a monitor; and c) further adjusting the RGB values until the viewer perceives that the color presentation matches the color patch, said step c) further comprising:

d) determining luminous conversion coefficients α and β;

i) converting the Y value into a luminance L* value according to a conversion equation $L^*=116\ (Y/Y_n)^{1/3}-16$, $Y_n$ being defined as 100;

ii) modifying the L* value by luminance conversion coefficients α and β into L'* which is defined by α(L*−β); and iii) converting the L'* back to a modified a Y' value which is defined by $Y_n((L'^*+16)/116)^3$; and e) storing said luminous conversion coefficients α and β.

12. The method of correcting predetermined CIE XYZ values according to claim 11 wherein said Y' value along with said X and Z values are substituted in the following equation for determining $R'_c$, $G'_c$ and $B'_c$:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

13. The method of correcting predetermined CIE XYZ values according to claim 11 wherein the ambient light and a light under which the predetermined CIE XYZ values were measured have different chromaticity coordinates.

14. The method of correcting predetermined CIE XYZ values according to claim 13 further comprising additional steps of:

d) adjusting the chromaticity coordinates of the CIE XYZ values until the viewer perceives that the chromaticity coordinates of the CIE XYZ values and the RGB values have the substantially same;

e) determining luminance conversion coefficients α and β; and f) storing the luminance conversion coefficients α and β.

15. The method of correcting predetermined CIE XYZ values according to claim 14 wherein said step e) further comprises additional steps of:

i) converting the Y value into a luminance L* value according to a conversion equation $L^*=116\ (Y/Y_n)^{1/3}-16$, $Y_n$ being defined as 100;

ii) modifying the L* value by luminance conversion coefficients α and β into L'* which is defined by α(L*−β); and iii) converting the L'* back to a modified a Y' value which is defined by $Y_n\ ((L'^*+16)/116)^3$.

16. The method of correcting a color representation on according to claim 15 wherein said Y' value along with said X and Z values are substituted in the following equation for determining $R'_C$, $G'_C$ and $B'_C$:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

17. A system for color matching between a display monitor and an image-carrying substrate, comprising:

a predetermined color patch on the image-carrying substrate, said predetermined color patch being specified by a first set of values including x, y and z values according to a first color system of CIE tri-stimulus under a predetermined light condition;

an output device for outputting a color output corresponding to said predetermined color patch, said corresponding color output being generated based upon a second set of R, G and B signals according to a second color system of RGB;

a light measuring device for taking a measurement of said light condition, a controller connected to said light measuring device for varying an intensity related value of said y value based upon said measurement so as to cause the corresponding color output from said output device appear substantially identical to said color patch, said controller further comprising a converter for converting said Y value into a L* value defining luminance by a first equation, $L^*=116\ (Y/Y_n)^{1/3}-16$, $Y_n$ being defined as 100, said converter modifying said L* value by luminance conversion coefficients α and β into L'* which is defined by α(L*−β), said convertor converts said L'* back to a modified a Y' value which is defined by $Y_n((L'^*+16)/116)^3$; and a signal generator connected to said controller and said output device for generating each of said signals of said second set based upon said varied intensity related value in said first set.

18. The system for color matching according to claim 17 further comprising an warning indicator for indicating that said measurement is outside of a predetermined range of values.

19. The system for color matching according to claim 17 wherein said signal generator generates said RGB values based upon Y' value along with said X and Z values, $R'_C$, $G'_C$ and $B'_C$ being generated based upon the following equation:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

20. The system for color matching according to claim 17 further comprising a memory for storing predetermined sets of said luminance conversion coefficients α and β.

21. The system for color matching according to claim 17 wherein said luminance conversion coefficients are determined on the fly.

22. The system for color matching according to claim 17 wherein said predetermined color patch and said display monitor are placed under a substantially identical light condition.

23. The system for color matching according to claim 17 wherein said predetermined color patch and said display monitor are displayed under a different light condition.

24. The system for color matching according to claim 23 wherein said display monitor is placed in a dark room.

25. The system for color matching according to claim 23 further comprising an adjuster for adjusting said first set of known values based upon said different light condition.

26. A system for converting predetermined CIE XYZ values of a color patch into RGB values of a monitor for viewing under ambient light, comprising:

a light measuring device for taking a measurement of the ambient light of substantially identical chromaticity coordinates of those for the predetermined CIE XYZ;

a first adjustor for adjusting the RGB values based upon the measurement for a color presentation on said monitor, said first adjustor including:

a determining device for determining luminance conversion coefficients $\alpha$and $\beta$; and a memory for storing the luminance conversion coefficients $\alpha$ and $\beta$;

said determining device converts the Y value into a luminance L* value according to a conversion equation $L^*=116\ (Y/Y_n)^{1/3}-16$, $Y_n$ being defined as 100, said determining device modifying the L* value by luminance conversion coefficients $\alpha$ and $\beta$ into L'* which is defined by $\alpha(L^*-\beta)$, said determining device converting the L'* back to a modified a Y' value which is defined by $Y_n((L'^*+16)/116)^3$; and a second adjustor for further adjusting the RGB values until the viewer perceives that the color presentation and the color patch are substantially identical.

27. The system for converting predetermined CIE XYZ values according to claim 26 wherein said second adjustor generates $R'_C$, $G'_C$ and $B'_C$ based upon said Y' value along with said X and Z values using the following equation:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

28. The system for converting predetermined CIE XYZ values according to claim 26 wherein the ambient light and light under which the predetermined CIE XYZ values are measured have different chromaticity coordinates.

29. The system for converting predetermined CIE XYZ values according to claim 28 further comprising:

a color coordinate adjustor for adjusting the color coordinates of the CIE XYZ values so that the color patch and the color presentation are perceived substantially identical;

a luminance adjustor for adjusting said Y value based upon the ambient light; and a memory for storing the luminance conversion coefficients $\alpha$ and $\beta$.

30. The system for converting predetermined CIE XYZ values according to claim 29 wherein said luminance adjustor converts the Y value into a luminance L* value according to a conversion equation $L^*=116\ (Y/Y_n)^{1/3}-16$, $Y_n$ being defined as 100; said luminance adjustor modifying the L* value by luminance conversion coefficients $\alpha$ and $\beta$ into L'* which is defined by $\alpha(L'^*-\beta)$, said luminance adjustor converting the L'* back to a modified a Y' value which is defined by $Y_n((L'^*+16)/116)^3$.

31. The system for correcting a color representation on according to claim 30, wherein said second adjustor generates $R'_C$, $G'_C$ and $B'_C$ based upon said Y' value along with said X and Z values using the following equation:

$$\begin{pmatrix} X \\ Y' \\ Z \end{pmatrix} = \begin{pmatrix} x_R & x_G & x_B \\ y_R & y_G & y_B \\ z_R & z_G & z_B \end{pmatrix} \begin{pmatrix} k_R \cdot f_1(R'_c) \\ k_G \cdot f_2(G'_c) \\ k_B \cdot f_3(B'_c) \end{pmatrix}$$

where $K_R$, $K_G$ and $K_B$ are predetermined.

* * * * *